US008615933B2

(12) United States Patent
Broderick et al.

(10) Patent No.: US 8,615,933 B2
(45) Date of Patent: Dec. 31, 2013

(54) BUILDING BLOCK

(76) Inventors: Stephen Day Broderick, Spring City, UT (US); Dennis LaMar Broderick, Spring City, UT (US)

( * ) Notice: Subject to any disclaimer, the term of this patent is extended or adjusted under 35 U.S.C. 154(b) by 1648 days.

(21) Appl. No.: 10/714,805

(22) Filed: Nov. 15, 2003

(65) Prior Publication Data

US 2004/0159052 A1 Aug. 19, 2004

Related U.S. Application Data

(60) Provisional application No. 60/426,841, filed on Nov. 15, 2002.

(51) Int. Cl.

| | |
|---|---|
| ***E04H 1/00*** | (2006.01) |
| ***E04H 3/08*** | (2006.01) |
| ***E04C 2/52*** | (2006.01) |
| ***E04C 2/04*** | (2006.01) |

(52) U.S. Cl.

USPC ..... 52/79.9; 52/79.14; 52/106; 52/220.8; 52/600

(58) Field of Classification Search

USPC ..... 52/439, 503, 585.1, 603–607, 293, 600, 52/602, 79.1, 91.1, 270, 284, 234, 106, 52/134, 169.6, 220.1, 220.3, 220.8, 52/79.9–79.14

See application file for complete search history.

(56) References Cited

U.S. PATENT DOCUMENTS

| | | | | |
|---|---|---|---|---|
| 2,691,291 | A * | 10/1954 | Henderson | 52/79.9 |
| 2,819,692 | A * | 1/1958 | Johnson et al. | 109/50 |
| 3,201,907 | A * | 8/1965 | Henderson | 52/73 |
| 3,577,672 | A * | 5/1971 | Nutting | 446/85 |
| 3,685,241 | A * | 8/1972 | Cooper | 52/270 |
| 3,805,467 | A * | 4/1974 | McCrillis et al. | 52/264 |
| 3,818,660 | A * | 6/1974 | Dillon | 52/251 |
| 3,877,187 | A * | 4/1975 | Livingston | 52/143 |
| 3,898,776 | A * | 8/1975 | Cox et al. | 52/79.14 |
| 3,902,287 | A * | 9/1975 | Livingston | 52/73 |
| 3,968,615 | A * | 7/1976 | Ivany | 52/439 |
| 4,075,808 | A * | 2/1978 | Pearlman | 52/439 |
| 4,091,587 | A * | 5/1978 | Depka | 52/421 |
| 4,214,408 | A * | 7/1980 | Rich, Jr. | 52/79.1 |
| 4,228,625 | A * | 10/1980 | Ruffer et al. | 52/407.3 |
| 4,514,949 | A * | 5/1985 | Crespo | 52/803 |
| 4,569,167 | A * | 2/1986 | Staples | 52/92.2 |
| 4,771,584 | A * | 9/1988 | Beard et al. | 52/596 |
| 4,811,536 | A * | 3/1989 | Hardt | 52/250 |
| 4,856,244 | A * | 8/1989 | Clapp | 52/309.7 |
| 5,758,461 | A * | 6/1998 | McManus | 52/293.3 |
| 5,867,964 | A * | 2/1999 | Perrin | 52/745.1 |
| 6,035,583 | A * | 3/2000 | Papke | 52/79.1 |
| 6,076,319 | A * | 6/2000 | Hendershot et al. | 52/271 |
| 6,195,950 | B1 * | 3/2001 | Harris | 52/270 |
| 6,240,700 | B1 * | 6/2001 | Sheu | 52/741.13 |
| 6,256,960 | B1 * | 7/2001 | Babcock et al. | 52/592.1 |
| 6,272,810 | B1 * | 8/2001 | Ingram et al. | 52/742.14 |
| 6,286,269 | B1 * | 9/2001 | Marcum | 52/79.5 |
| 6,493,996 | B1 * | 12/2002 | Alexander et al. | 52/79.9 |

(Continued)

*Primary Examiner* — William Gilbert

(57) ABSTRACT

A one story high building block with the capability of having window or door openings, or a variety of other desirable features; pre-cast within the body of the building block itself. The building block can be colored and stamped or etched to provide an almost endless variety of visual effects. The building block can be connected to a number of other building blocks, each with their own variety of features, to create a dynamic building.

4 Claims, 10 Drawing Sheets

(56) References Cited

U.S. PATENT DOCUMENTS

| | | | | |
|---|---|---|---|---|
| 6,539,674 | B2 * | 4/2003 | Arnold | 52/79.1 |
| 6,609,336 | B2 * | 8/2003 | Matsubara | 52/79.12 |
| 6,721,684 | B1 * | 4/2004 | Saebi | 702/183 |
| 6,955,016 | B1 * | 10/2005 | Churches et al. | 52/236.3 |
| 6,983,567 | B2 * | 1/2006 | Ciotti | 52/79.5 |
| 7,086,209 | B1 * | 8/2006 | Pruitt et al. | 52/745.13 |
| 2002/0069603 | A1 * | 6/2002 | Zornes | 52/612 |
| 2002/0104271 | A1 * | 8/2002 | Gallant | 52/36.1 |
| 2003/0093965 | A1 * | 5/2003 | Miller | 52/600 |
| 2004/0221529 | A1 * | 11/2004 | Zornes | 52/311.1 |
| 2005/0081465 | A1 * | 4/2005 | Crumley | 52/223.1 |

* cited by examiner

BUILDING BLOCK

CROSS REFERENCE TO RELATED APPLICATIONS

This application claims the benefit of Disclosure Document No. 60/426,841 filed Nov. 15, 2002, entitled "C-Block" which is hereby incorporated by reference herein in its entirety, including but not limited to those portions that specifically appear hereinafter.

STATEMENT REGARDING FEDERALLY SPONSORED RESEARCH OR DEVELOPMENT

Not applicable.

BACKGROUND OF THE INVENTION

1. The Field of the Invention

The present invention relates generally to Building Blocks for construction purposes, and more particularly, but not necessarily entirely, to a large steel reinforced composite or concrete block, usually colored and stamped or etched to resemble stone, brick or other visually appealing façade or building interior.

2. Description of Related Art

The prior art discloses a number of building blocks. The cinderblock, for instance has been utilized in construction for many years. However, the cinderblock, as well as other prior art building blocks, is limited in size and scope. Relatively small, the cinderblock must be placed each one by hand, requiring considerable time and labor to complete the construction of a wall. The cinderblock is also primarily used for structural purposes and usually requires additional construction material to achieve a 'finished' look or to house the necessary insulation and electrical wiring, outlet and switch boxes. In scope, the prior art fails to disclose a pre-insulated, steel reinforced single story high building block which can be placed quickly by machinery, with windows and doors pre-cast within the embodiment of the block itself, with window and door moldings pre-attached. The prior art also fails to disclose a building block of such 'finished' quality that once it is set and sealed, no other material or process is required in order to have a finished wall for a building. The prior art also fails to disclose a building block that can be attached to other building blocks by weld-plates. The prior art also fails to disclose a building block that has its own vapor barrier. The prior art also fails to disclose a building block that might have a built-in footing. The prior art also fails to disclose a building block that has built-in utility receptacles. The prior art also fails to disclose a building block that has beveled interior coners to receive and expedite sealing material for the building block joints. The prior art also fails to disclose a building block that has pre-cast receptacles for a variety of 'built-ins', such as chest of drawers, aquariums, shelves, window seats, or fireplaces.

The prior art is thus characterized by several disadvantages that are addressed by the present invention. The present invention minimizes, and in some aspects eliminates, the above-mentioned failures and other problems, by utilizing the methods and structural features described herein.

BRIEF SUMMARY AND OBJECTS OF THE INVENTION

It is therefore an object of the present invention to provide a building block of sufficient dimension to be considered, by itself, a single story high.

It is another object of the present invention to provide a building block capable of accommodating a variety (of sizes and shapes) of windows, and of doors, to be pre-cast within the embodiment of the block itself.

It is another object of the present invention to provide a building block capable of providing a variety of desirable features such as shelves, workbench, utility and 'built-in' receptacles pre-cast within the embodiment of the block itself.

It is a further object of the present invention to provide a building block of sufficient size and strength to be capable of withstanding, in most cases, the furies of nature (i.e. fire, hurricanes, tornadoes, floods) and the machinations of man.

It is an additional object of the present invention to provide a building block, which can be permanently colored and stamped or etched at the point of manufacture to satisfy the desires of the end-user.

It is a further object of the present invention to provide a building block, which can accommodate an almost endless variety of uses.

The above objects and others not specifically recited are realized in a specific illustrative embodiment of a building block. The building block includes two perpendicular walls, the exterior wall and the interior wall attached in parallel by a webbing.

The walls and the webbing of the building block are constructed of cement, sand, aggregate, re-enforcement steel, and in some cases, artificial pozzolan or other strengthening composite. The face of the exterior wall can be colored and stamped or etched to provide almost any visual effect. Such stamping, coloring, and/or etching are performed before the cement has cured, and becomes permanent upon the curing of the cement (concrete). The interior wall is, generally, flat and smooth. However, variations may be implemented, including, but not limited to: openings of various sizes and shapes may be cast within the interior wall during the manufacturing of the building block, to accommodate such things as electrical outlets and switches, 'built-in' cabinets, aquariums, chest of drawers or fireplace. The interior wall of the building block may, also, be re-structured as a complete or partial wall of shelves or shelves with a workbench or table. Foam insulation is placed between the interior and exterior walls of the building block during manufacturing, and becomes permanent. Windows and doors and other desired openings might be cast during manufacturing and become a permanent part of that particular block. Window and door molding may also be placed during the building block manufacturing process, and become a permanent part of that particular block. The building blocks are attached together by a series of strategically placed weld-plates.

Additional objects and advantages of the invention will be apparent from the description, or may be learned by the practice of the invention without undue experimentation. The object and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
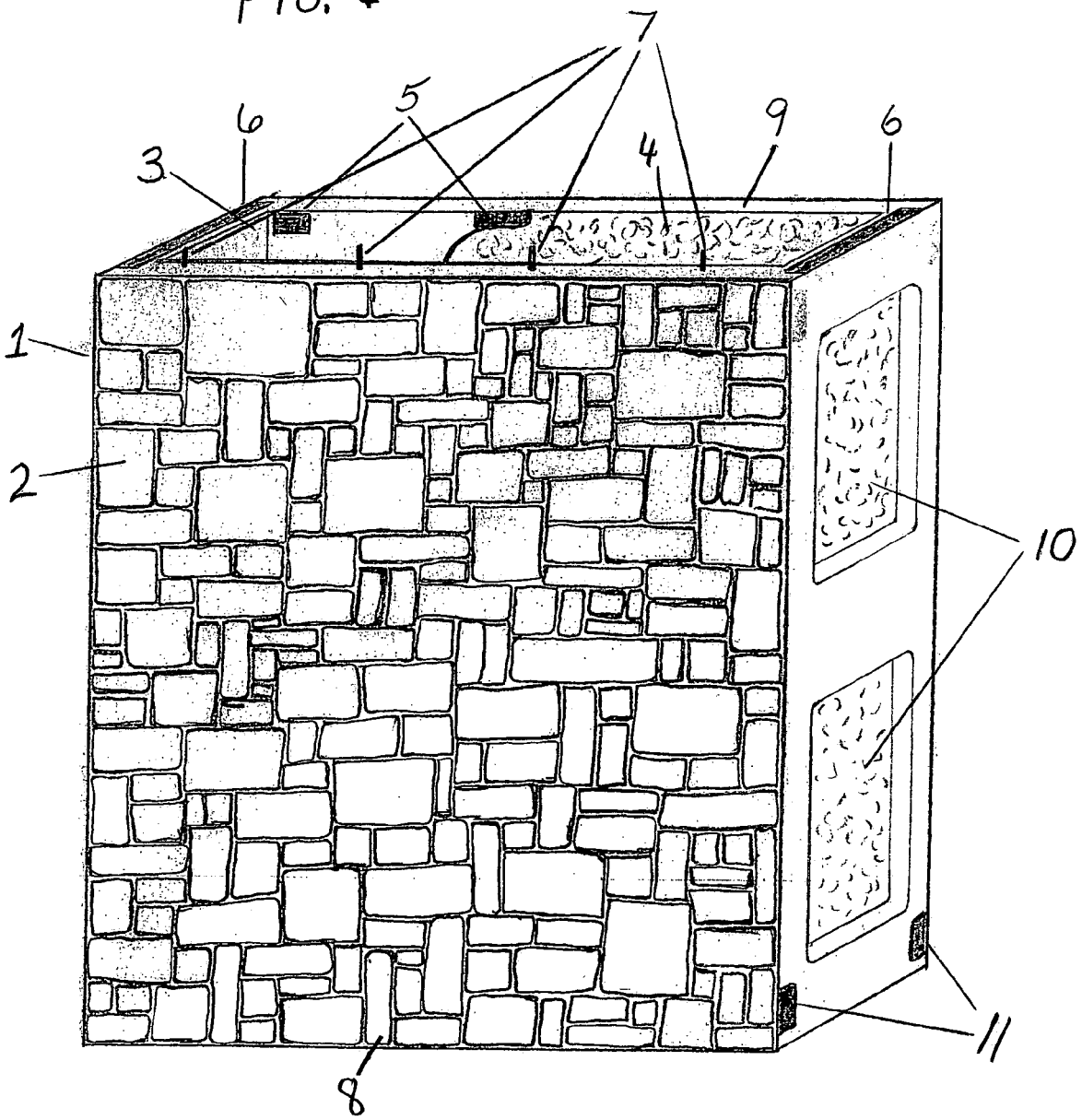
FIG. 1 is a perspective view of the exterior side of a standard building block.

For the purpose of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the inventions as illustrated herein, which would normally occur to one skilled in the relevant art and having possession of this disclosure, are to be considered within the scope of the invention claimed.

Before the present device of a building block is disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice is hereby incorporated by reference herein. The references discussed herein are provided solely for their disclosure prior to the filing date of the present application. Nothing herein is to be construed as a suggestion or admission that the inventors are not entitled to antedate such disclosure by virtue of prior invention.

It must be noted that, as used in this specification and the appended claims, the singular forms 'a,' 'an,' and 'the' include plural referents unless the context clearly dictate otherwise.

In describing and claiming the present invention, the following terminology will be used in accordance with the definitions set below.

As used herein, the terms 'comprising,' 'including,' 'containing,' 'characterized by,' and grammatical equivalents thereof are inclusive or open-ended terms that do not exclude additional, unrecited elements or method steps.

As used herein, the phrase 'consisting of' and grammatical equivalents thereof exclude any element, step, or ingredient not specified in the claim.

As used herein, the phrase 'consisting essentially of' and grammatical equivalents thereof limit the scope of a claim to the specified materials or steps and those that do not materially affect the basic and novel characteristic or characteristics of the claimed invention.

As used herein, the phrase 'building block' and grammatical equivalents thereof shall refer to an object that is used primarily for building, erecting, or constructing a building or edifice.

As used herein, the phrase 'block' and grammatical equivalents thereof shall refer to a hollow, (generally) rectangular shaped building unit made of cement, sand, and aggregate.

As used herein, the phrase 'hollow' and grammatical equivalents thereof shall refer to the space between two solid surfaces of a contiguous building block.

Referring now to FIG. 1, there is shown a perspective view of a standard building block 1 with the exterior face 2 shown as being stamped to resemble stone the building block can be any size, but in its present embodiment preferably nine feet tall, eight feet wide, and eighteen inches deep. The face can be stamped or etched and colored to resemble stone brick or other visually appealing façade. Between the exterior wall 8 and the interior wall 9 of the building block 1 there is a hollow space 3 which houses the expanded polystyrene insulation 4 and the electrical wiring and plumbing, (not shown). There is also within the hollow space 3, a series of weld plates 5 which are used to attach one building block to another building block, top to bottom. Upon the upper edges on each side of the building block 1 there are weld plates 6 which are used to attach building blocks side by side. Also on the bottom of each side (the right side shown in this perspective view), there are weld plates 11 which are also used to attach blocks side by side. On the top edge of the exterior face 8 there are shown a series of 'J' bolts 7 which are placed and pre-cast into the concrete in order to hold the structural member, which will attach the roof to the building block. On the right hand side of the building block 1 there are two openings 10 which are used to restrict the transfer of heat and cold, which travels more readily through concrete, and to house expanded polystyrene insulation 4.

Figure 2B:
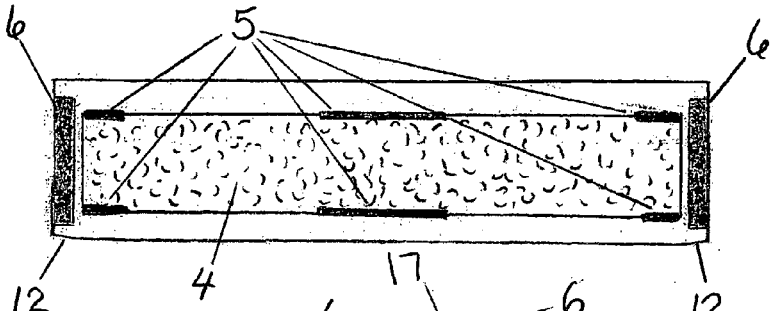
FIG. 2B is a top view of a standard building block.
Figure 2A:
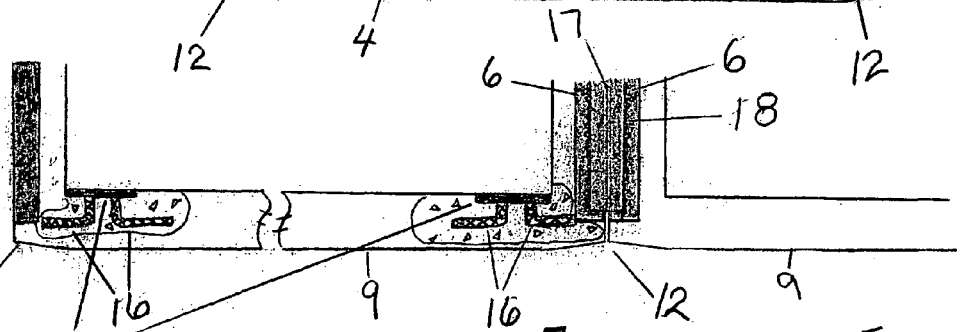
FIG. 2A is a cut-away top view of the attachment means that connects two building blocks side by side.
Figure 2:
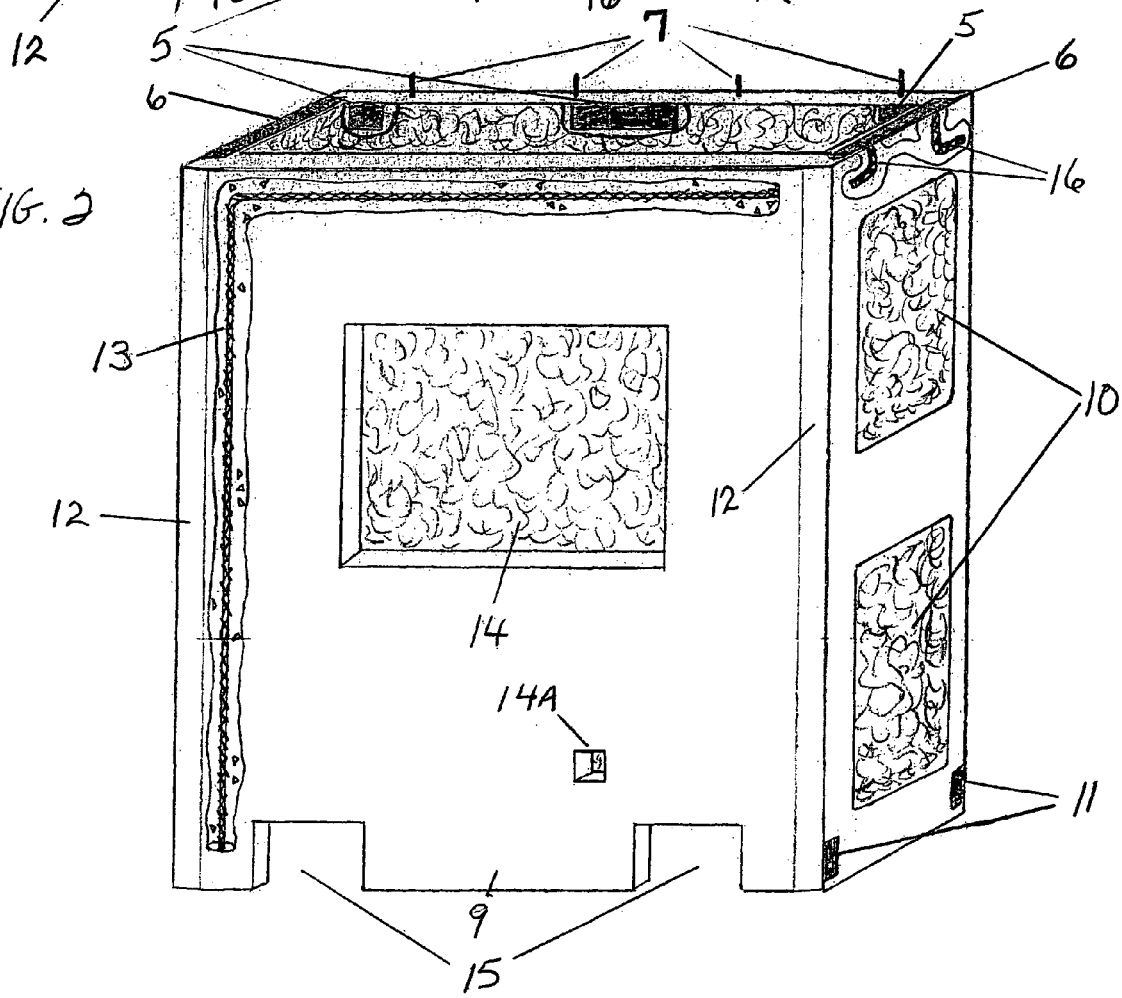
FIG. 2 is a perspective view of the interior side of a standard building block.

Referring now to FIG. 2, there is shown a perspective view of the interior wall of the building block 1. There is a partial breakaway view of reinforcement steel 13. The size and amount of reinforcement steel used is based upon engineering specifications. There are openings 14 pre-cast in the interior wall of the building block 1. The size of the openings 14 will vary depending upon the use, such as, there will be openings 14A of different sizes for electrical receptacles or built-ins like chest of drawers or shelves or aquariums or anything determined by those skilled in the art. There are openings 15 at the bottom of the interior wall 9. These openings 15 will only be on those building blocks, which will be placed on top of another building block. These openings 15 will be used by the welder for access to the weld plates on the interior of the block once the block is placed upon another in order to attach the top block to the bottom block.

Referring now to FIG. 2A, there is shown a partial top view of a building block 1, in which there is partial breakaway view of reinforcement steel 16 attached or welded to weld plates 5 in order to strengthen the attachments when the blocks are attached together. On each corner of the interior wall 9 there is a beveled edge 12, which is used to receive the sealing material between the joints of the two adjacent blocks. Weld plate 17 is placed upon weld plate 6 on the left block and weld plate 6 on the right block and a weld bead 18 is then applied which holds the two blocks firmly together.

Figure 3:
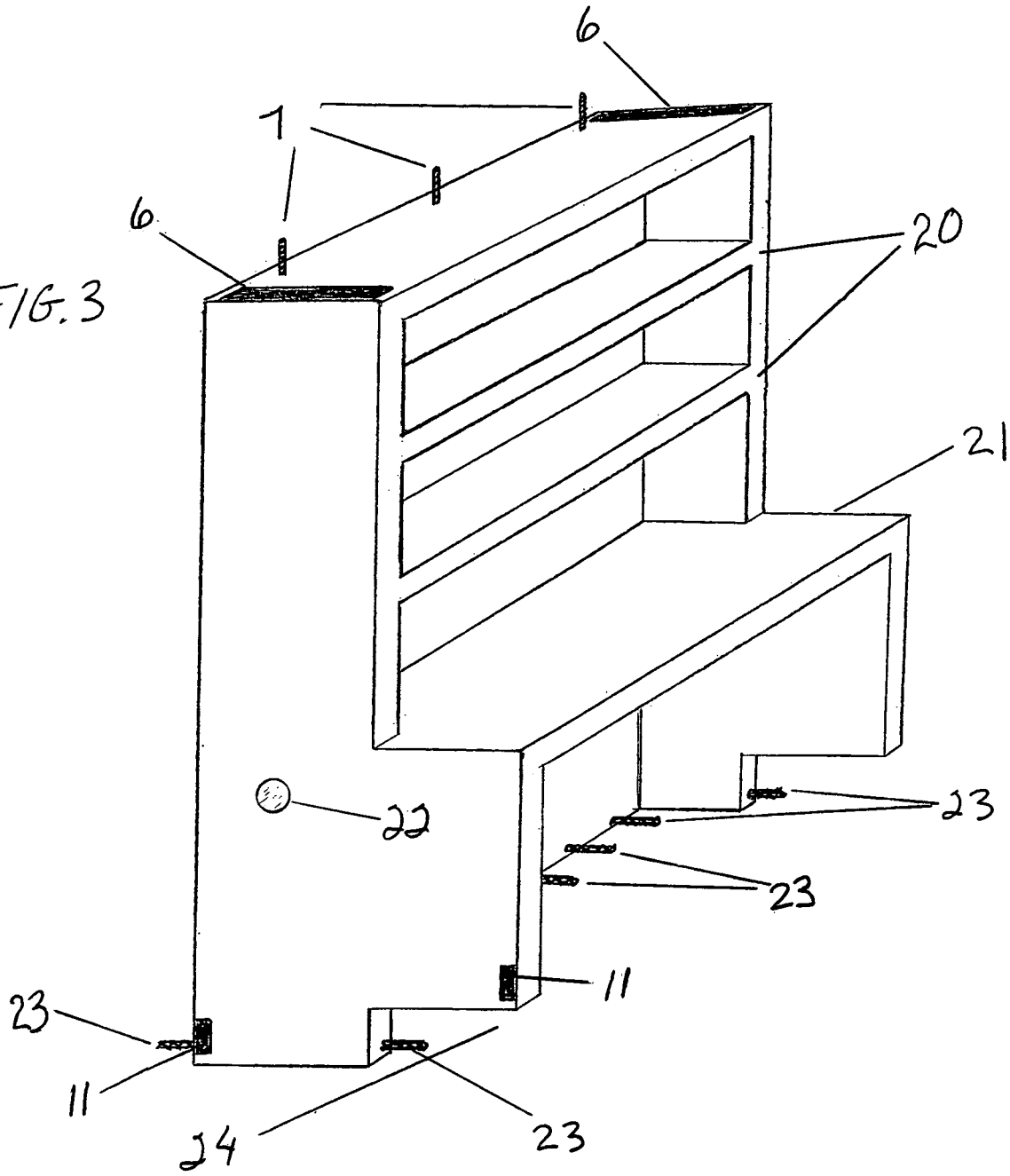
FIG. 3 is a perspective view of an alternative embodiment of the building block showing the interior wall as shelves and workbench or table.

Referring now to FIG. 3, there is shown a perspective view of the interior wall of building block 1 which has shelves 20 and a work bench 21 pre-cast into the interior wall. There is an opening 22 pre-cast into each side of the block used to route utility wires or lines. Reinforcement steel 23 is projecting from the base of the building block, which is used to hold the block to the footing once the concrete is poured over the reinforcement steel 23. A toe-kick 24 is pre-cast into the building block so that a person working at the workbench 21 will be comfortable and not catch their foot on the sides of the building block.

Figure 4:
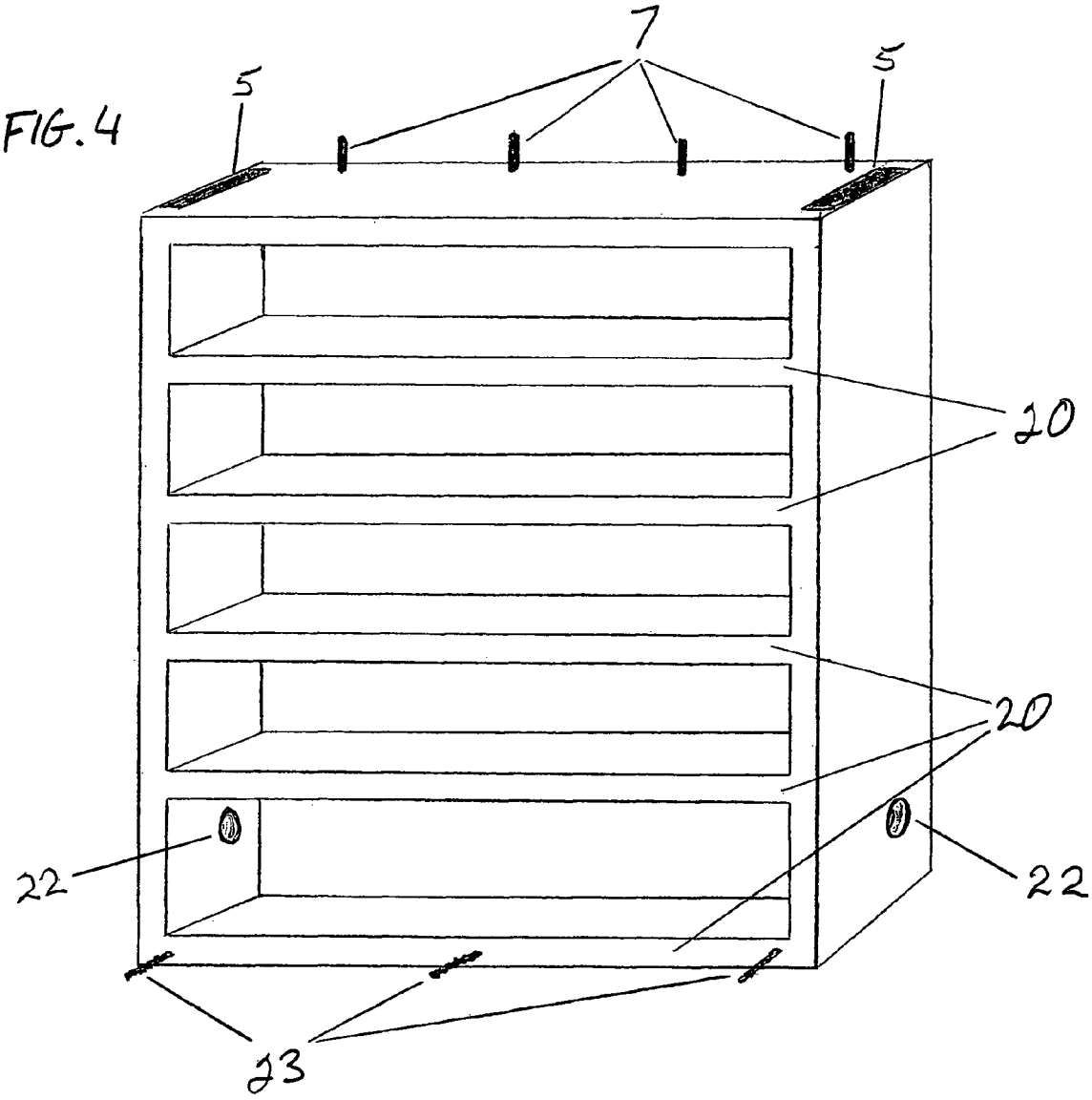
FIG. 4 is a perspective view of an alternative embodiment of the building block showing the interior wall as shelves.

Referring now to FIG. 4, there is shown a perspective view of the interior wall of a building block that is pre-cast with shelves 20 the full height of the building block.

Figure 5:
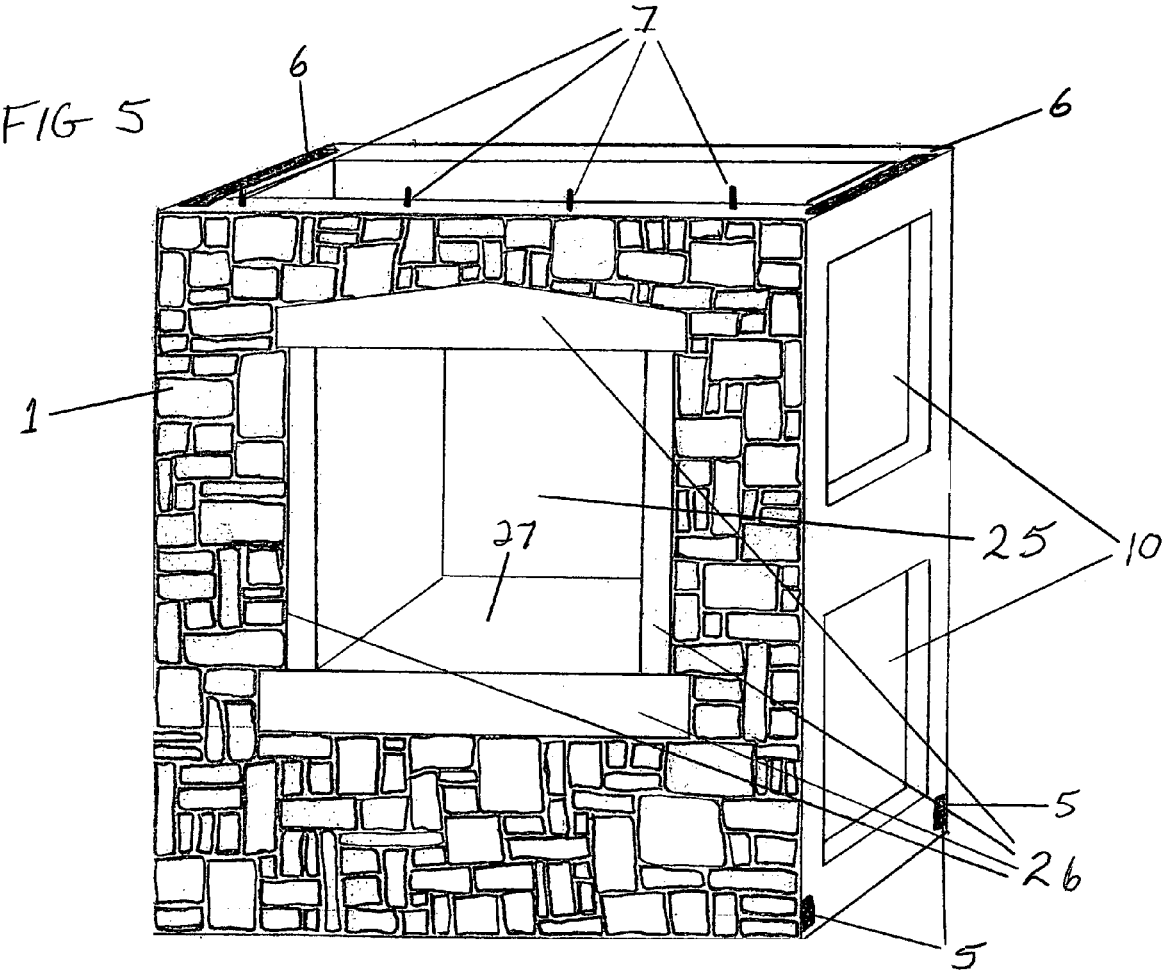
FIG. 5 is a perspective view of the exterior side of a standard building block showing a window pre-cast into the embodiment of the building block.

Referring now to FIG. 5, there is shown a perspective view of the building block 1 with a window opening 25 pre-cast into the embodiment of the building block 1. There is window-molding 26 placed around the window opening 25 and there is a window seat 27 at the base of the window opening 25.

Figure 6:
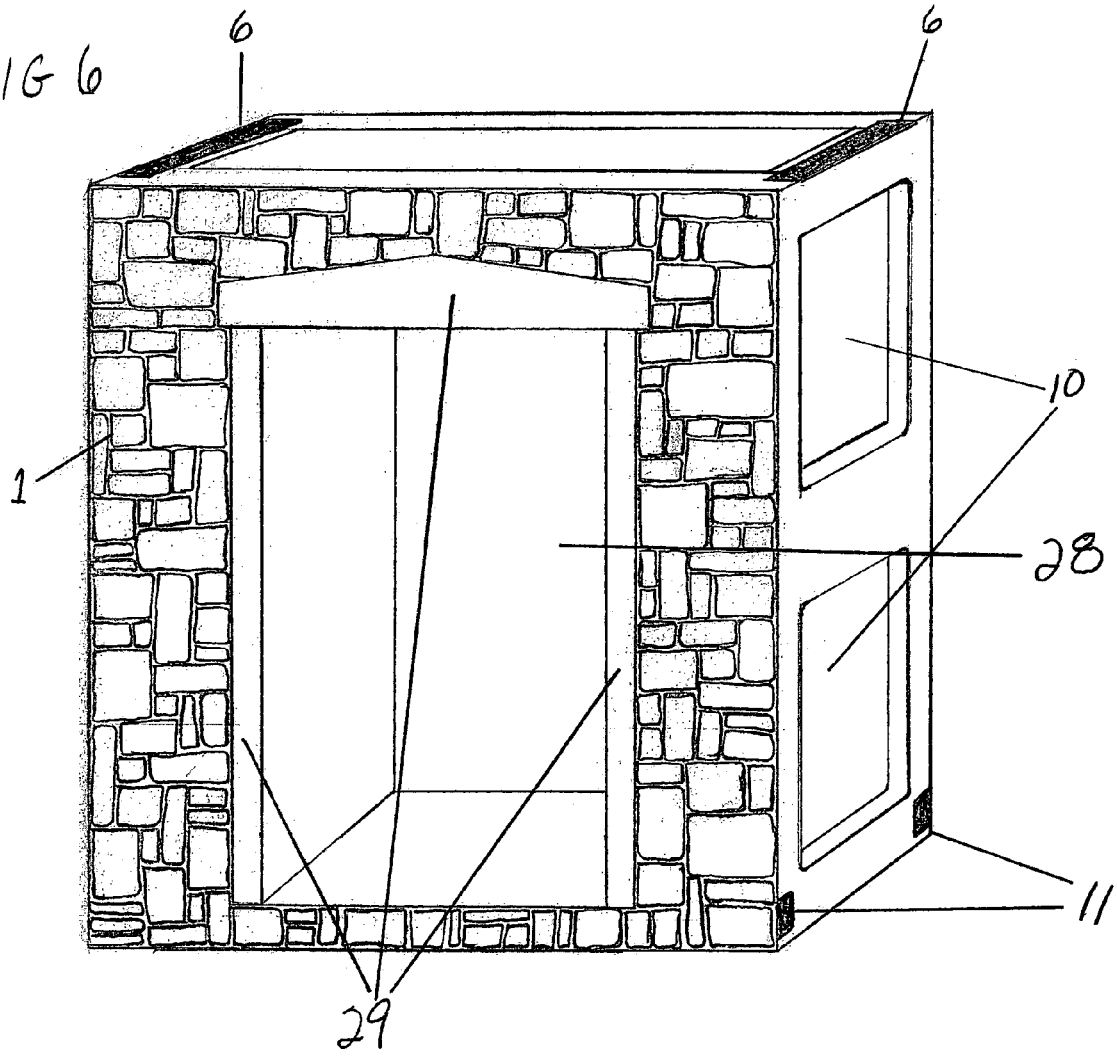
FIG. 6 is a perspective view of the exterior side of a standard building block showing a door pre-cast into the embodiment of the building block.

Referring now to FIG. 6, there is shown a perspective view of building block 1 with a door opening 28 pre-cast into the embodiment of the building block 1 with door molding 29 attached to the door opening of the building block 1.

Figure 7:
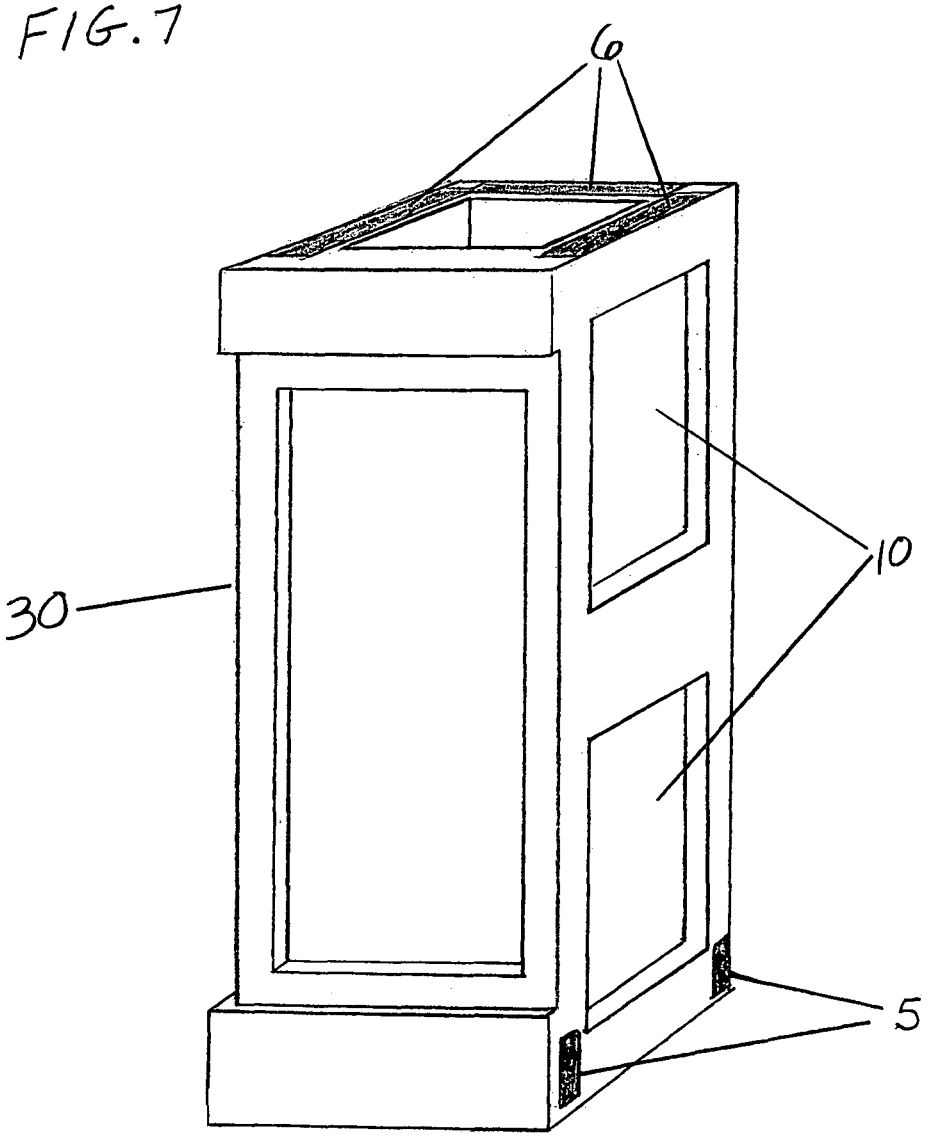
FIG. 7 is a perspective view of the exterior side of a building block showing a window, which has been pre-cast into the embodiment of the building block, and showing a corner building block and an entablature building block attached.

Referring now to FIG. 7, there is shown a perspective view of a corner block 30 with the capability of being attached at the corner of the right angels at a corner of a building.

Figure 8:
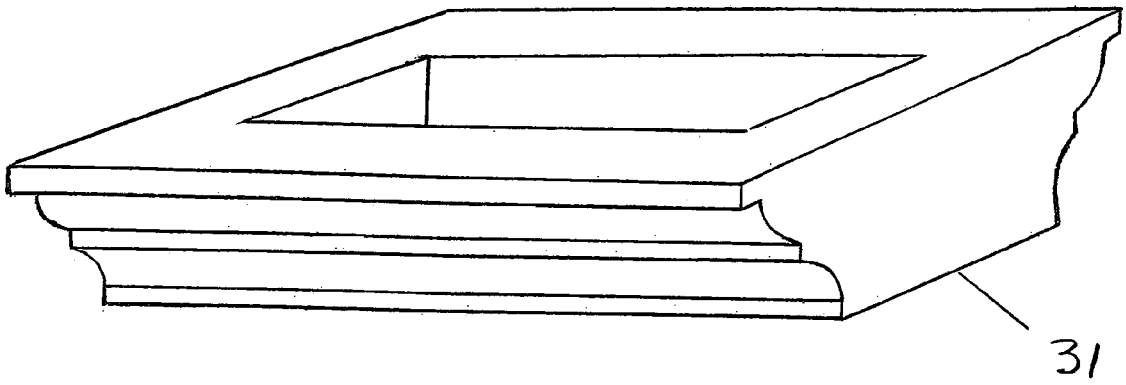
FIG. 8 is a perspective view of a discretionary, decorative entablature block

Referring now to FIG. 8 there is shown a perspective view of an alternative discretionary decorative entablature building block 31.

Figure 9:
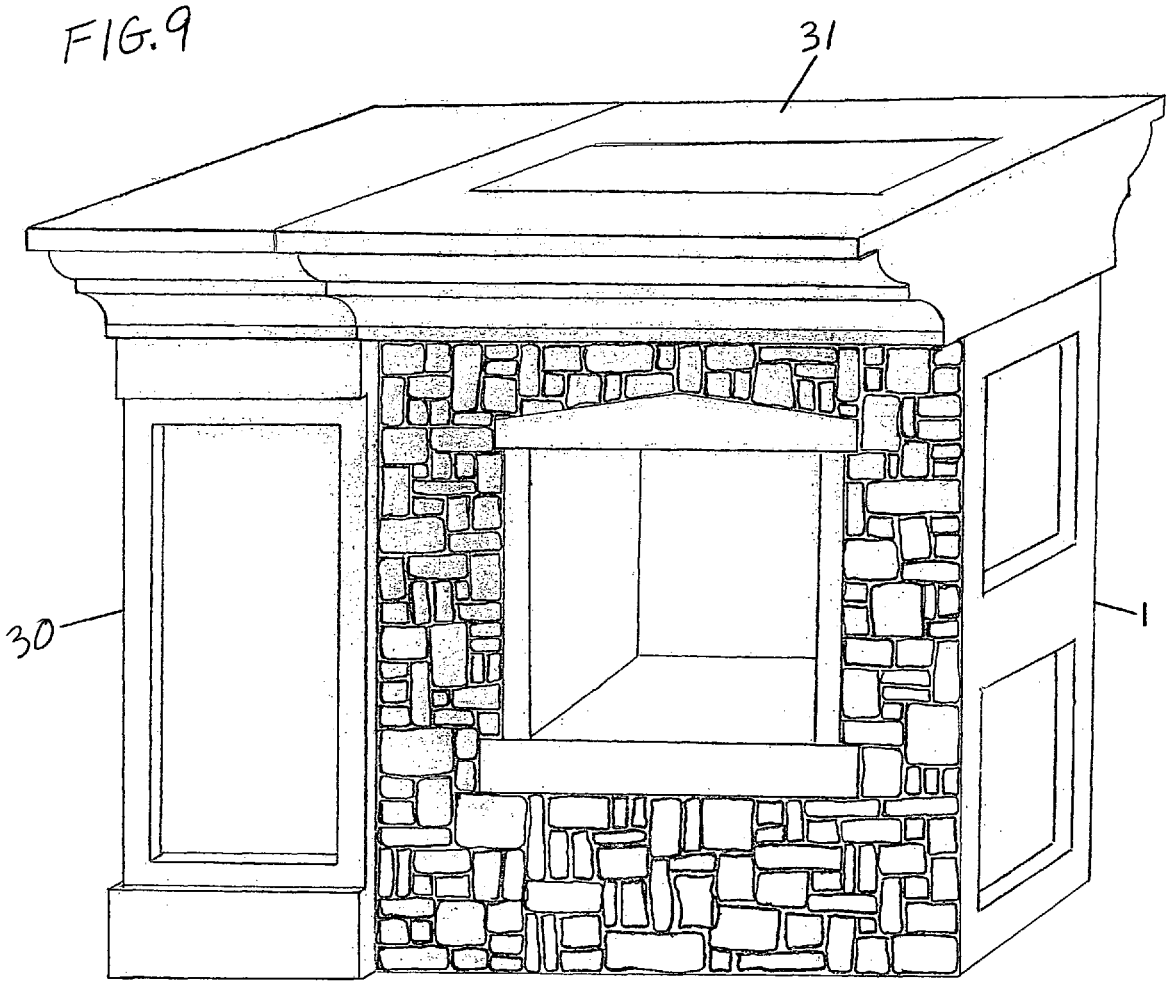
FIG. 9 is a perspective view of a standard building block with a window, attached to a corner block, and attached to a discretionary, decorative entablature block.

Referring now to FIG. 9 there is shown a perspective view of building block 1 with a window, attached to a corner block 30, also attached to an entablature block 31.

Figure 9A:
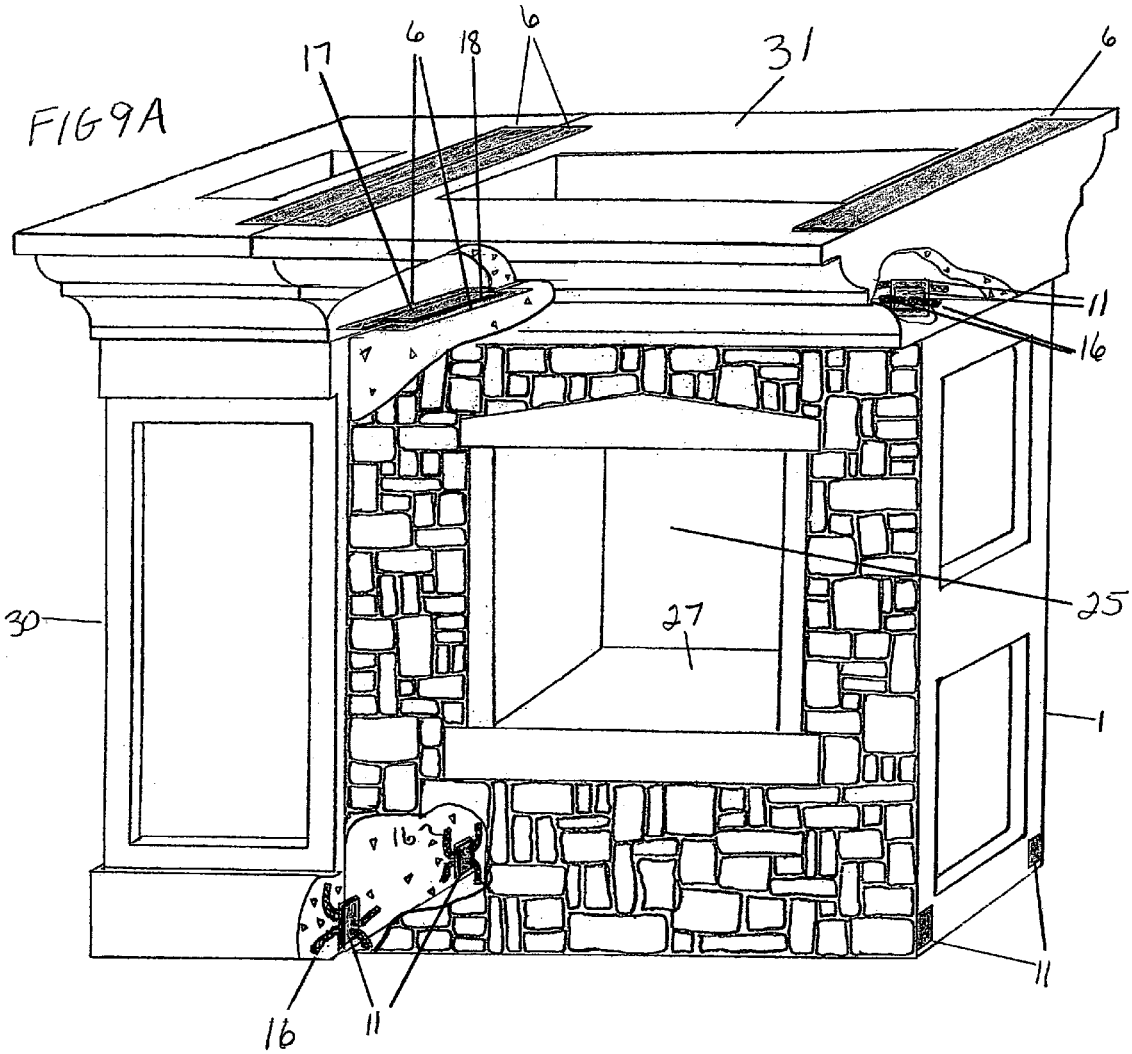
FIG. 9A shows the attachment means by which all blocks in FIG. 9 are attached.

Referring now to FIG. 9A there is shown the attachment means of the building blocks of FIG. 9.

It is to be understood that the above-described arrangements are only illustrative of the application of the principles of the present invention. Numerous modifications and alternative arrangements may be devised by those skilled in the art without departing from the spirit and scope of the present invention. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function, assembly and use may be made without departing from the principles and concepts set forth herein.

What is claimed is:

1. A building block comprising:

a reinforced concrete structure having four walls defining a hollow enclosure, said enclosure defined by an interior main surface of each said respective wall, each said respective wall further comprising an exterior main surface substantially parallel to each respective interior main surface, an upper surface and a lower surface;

at least one J-bolt extending from at least one of said upper surfaces;

at least one weld plate embedded and having an exposed surface substantially flush with at least one of said upper surfaces, each said weld plate having reinforcement steel attached to an embedded surface and extending into said concrete structure;

at least a second weld plate embedded and having an exposed surface substantially flush with at least one of said interior main surfaces;

at least one of said walls has at least one channel extending from said respective interior main surface to said respective exterior main surface, said channel extending to said lower surface of said respective wall; and at least one said exterior main surface having a side edge extending from said respective lower surface to said respective upper surface and configured to receive a seal.

2. The building block of claim 1, wherein at least one of said exterior surfaces has a finish selected from the group consisting of stamping, coloring, etching, and combinations thereof.

3. The building block of claim 1, wherein foam insulation is placed within said hollow enclosure.

4. The building block of claim 1, wherein said building block has a height of one story.

* * * * *